US009550222B2

(12) United States Patent
Butcher et al.

(10) Patent No.: US 9,550,222 B2
(45) Date of Patent: Jan. 24, 2017

(54) BODYMAKER AND DOUBLE ACTION DOMER ASSEMBLY WITH STAGED PISTON

(71) Applicant: STOLLE MACHINERY COMPANY, LLC, Centennial, CO (US)

(72) Inventors: Gregory H. Butcher, Urbana, OH (US); James A. McClung, Canton, OH (US); Paul L. Ripple, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 1133 days.

(21) Appl. No.: 13/623,894

(22) Filed: Sep. 21, 2012

(65) Prior Publication Data

US 2014/0083156 A1 Mar. 27, 2014

(51) Int. Cl.

| | |
|---|---|
| ***B21D 22/30*** | (2006.01) |
| ***B21D 51/26*** | (2006.01) |
| ***B21D 22/22*** | (2006.01) |

(52) U.S. Cl.

CPC ..... *B21D 22/22* (2013.01); *B21D 22/30* (2013.01); *B21D 51/26* (2013.01)

(58) Field of Classification Search

CPC ..... B21D 51/24; B21D 51/26; B21D 22/24; B21D 22/26; B21D 22/30; B21D 22/22

See application file for complete search history.

(56) References Cited

U.S. PATENT DOCUMENTS 3,771,345 A * 11/1973 Paramonoff ..... B21D 51/26 72/349
3,786,667 A 1/1974 Garnett, Jr.
4,574,608 A * 3/1986 Bulso, Jr. ..... B21D 51/44 413/62
4,620,434 A 11/1986 Pulciano et al.
4,732,031 A 3/1988 Bulso, Jr. et al.
5,272,902 A 12/1993 Kobak (Continued)

FOREIGN PATENT DOCUMENTS

CN 1129412 8/1996

OTHER PUBLICATIONS

Stolle Machinery Company, LLC, PCT Search Report, dated Feb. 19, 2014, Application No. PCT/US2013/060303, filed Sep. 18, 2013, 3 pages.

(Continued)

*Primary Examiner* — Moshe Wilensky
*Assistant Examiner* — Pradeep C Battula
(74) *Attorney, Agent, or Firm* — Eckert Seamans Cherin & Mellott, LLC; David C. Jenkins

(57) ABSTRACT

A domer station having a domer assembly, a housing assembly, and a stacked piston assembly is provided. The domer assembly is movably disposed within a domer body passage located in the housing assembly and structured to move between a forward, first position and a retracted, second position. The stacked piston assembly includes a plurality of pistons, preferably three pistons, disposed in series and a pressure supply. The pistons are disposed behind the domer in pressure chambers. The pistons have a constant pressure applied thereto and are biased towards the domer. The pistons are, however, each restrained by a stop and do not contact, or operatively engage, the domer when the domer is in the domer first position.

13 Claims, 6 Drawing Sheets

(56) References Cited

U.S. PATENT DOCUMENTS

| | | | | |
|---|---|---|---|---|
| 5,617,755 | A * | 4/1997 | Cheers | B21D 22/28 72/349 |
| 5,626,048 | A | 5/1997 | McClung | |
| 5,628,224 | A | 5/1997 | McClung et al. | |
| 5,768,932 | A | 6/1998 | Hahn | |
| 7,000,445 | B2 * | 2/2006 | Hepner | B21D 22/24 413/69 |
| 7,124,613 | B1 * | 10/2006 | McClung | B21D 22/30 72/348 |
| 2002/0170334 | A1 | 11/2002 | Zauhar | |
| 2005/0126247 | A1 | 6/2005 | Hepner et al. | |
| 2009/0249856 | A1 | 10/2009 | Smyers et al. | |

OTHER PUBLICATIONS

Stolle Machinery Company, LLC, EP13838503.4 Search Report, Apr. 19, 2016, 7 pages.

* cited by examiner

BODYMAKER AND DOUBLE ACTION DOMER ASSEMBLY WITH STAGED PISTON

BACKGROUND OF THE INVENTION

1. Field of the Invention

The disclosed and claimed concept relates to forming a cup-shaped body and, more specifically, to providing an inwardly extending dome to a cup-shaped body.

2. Background Information

It is known in the container-forming art to form two-piece containers, e.g. cans, in which the walls and bottom of the container are a one-piece cup-shaped body, and the top or end closure is a separate piece. After the container is filled, the two pieces are joined and sealed, thereby completing the container. The cup-shaped body typically has a domed end. That is, the cup-shaped body typically begins as a flat material, typically metal, either in sheet or coil faun. Blanks, i.e. disks, are cut from the sheet stock and then drawn into a cup. That is, by moving the disk through a series of dies while disposed over a ram or punch, the disk is shaped into a cup having a bottom and a depending sidewall. The cup may be drawing through additional dies to reach a selected length and wall thickness. One of the last deformations applied to the cup is forming an inwardly extending dome to the bottom of the cup. That is, the cup is moved into engagement with a domer; the domer having a domed end onto which the cup is pressed. This action typically occurs at the end of the stroke of the punch. In this configuration, the presses produce excessive noise, vibration and stress on the press due to the engagement of the ram with the domer.

That is, when the punch, having a cup-shaped body disposed thereon, engages the domer, there is an impact. The impact is noisy, causes the press to vibrate, and induces stress on both the punch and the domer. This is especially true if the domer is fixed. One method of reducing the force of the impact was to provide a floating domer, i.e., the domer was movable in a direction parallel to the longitudinal axis of the punch. In such a device, the domer could be mounted on a spring and/or a piston. In this configuration, after the bottom of the cup-shaped body was deformed, the domer could move away from the punch, thereby reducing the force of the impact. The disadvantage to this configuration is that the domer was still structured to apply the force required to deform the cup-shaped body in, essentially, a single instant. While the movable domer reduced some of the force of the impact, the force was still significant.

SUMMARY OF THE INVENTION

The disclosed and claimed concept provides for a domer station having a domer assembly, a housing assembly, and a stacked piston assembly. The domer assembly is movably disposed within a domer body passage located in the housing assembly and structured to move between a forward, first position and a retracted, second position. The stacked piston assembly includes a plurality of pistons, preferably three pistons, disposed in series and a pressure supply. The pistons are disposed behind the domer in pressure chambers. The pistons have a constant pressure applied thereto and are biased towards the domer. The pistons are, however, each restrained by a stop and do not contact, or operatively engage, the domer when the domer is in the domer first position. Further, the pistons are spaced from each other.

When the punch, having a cup-like body disposed thereon, engages the domer, the domer begins to move toward its second position. That is, the punch biases the domer toward the domer second position. The domer contacts the first piston which operatively engages the domer. That is, the piston applies a bias to the domer and, more specifically a bias toward the domer first position, i.e. opposite the bias of the punch. This bias is not sufficient to cause the bottom of the cup-like body to deform completely, but the deformation may start. The bias is also insufficient to stop the motion of the punch and the domer. As such, the domer is still moving toward the domer second position. Because the pistons are spaced, there is a moment wherein the domer engages the first piston, but before the first piston moves into contact with the second piston. That is, the first piston applies an incremental pressure to the domer.

Once the first piston moves into contact with the second piston, the second piston also applies a bias to the domer via the first piston. Again, the bias of the two pistons is not sufficient to cause the bottom of the cup-like body to deform completely, but the deformation may continue. The bias of the two pistons is also insufficient to stop the motion of the punch and the domer. Thus, the domer continues toward the domer second position. As with the first and second pistons, and because of the gap between the second and third pistons, there is a moment wherein the domer engages the first and second pistons, but before the second piston moves into contact with the third piston. That is, the first and second pistons apply an incremental pressure to the domer. Once the second piston moves into contact with the third piston, the third piston also applies a bias to the domer via the first and second piston. The third piston may move slightly, but the bias applied by all three pistons is sufficient to completely deform the cup-like body and to arrest the motion of the domer. When this occurs, the domer is in the domer second position. Also, at this point the punch is at its maximum extension and no longer biases the domer toward the domer second position.

Immediately thereafter, the pressure acting on the pistons creates a sufficient bias to move the domer toward the domer first position. As each piston contacts its associated stop, that piston stops moving. When the first piston reaches its associated stop, the domer is returned to its first position. At this point, the punch typically ejects the cup-like body, which now has a domed bottom, and picks up another cup-like body and the cycle repeats. Because the domer moves and the pistons apply incremental pressure to arrest the domer motion, the force of the impact of the punch on the domer is divided and spaced over time. This reduces the stress on the machine.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "stacked piston assembly" includes two or more pistons structured to move over a common axis. That is, the pistons are substantially aligned. Further, a "stacked piston assembly" means that the pistons within the assembly are disposed adjacent to each other and are structured to operatively engage a common element.

As used herein, "operatively engage" when used in reference to a piston means that the piston is structured to apply bias to another element by either direct or indirect contact. For example, a piston that directly contacts another element may "operatively engage" the other element. Further, a piston that contacts an intermediate element, e.g. another piston or a seal, that contacts the other element may "operatively engage" the other element. It is further noted that a piston may not "operatively engage" without direct or indirect contact. That is, if a piston pressurizes a chamber, and the pressurized fluid in the chamber creates bias on another element, the piston does not "operatively engage" the other element.

As used herein, "directly engaging" when used in reference to a piston means that the piston, or a part of the piston, e.g. a coating or a pad coupled to the piston, contacts the other element. It is noted that with a stacked piston assembly, only the piston immediately adjacent an object can "directly engage" the object. That is, a second or other subsequent piston in a stacked piston assembly does not "directly engage" the other object via the first piston.

As used herein, "disposed in series," when used in reference to a plurality of pistons, means that the pistons are disposed along, and structured to travel over, a substantially common axis. Further, the pistons directly, or indirectly, engage an adjacent piston and more preferably operatively engage an adjacent piston. That is, pistons that are merely disposed along, and structured to travel over, a substantially common axis without engaging each other are not "disposed in series."

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

Figure 1:
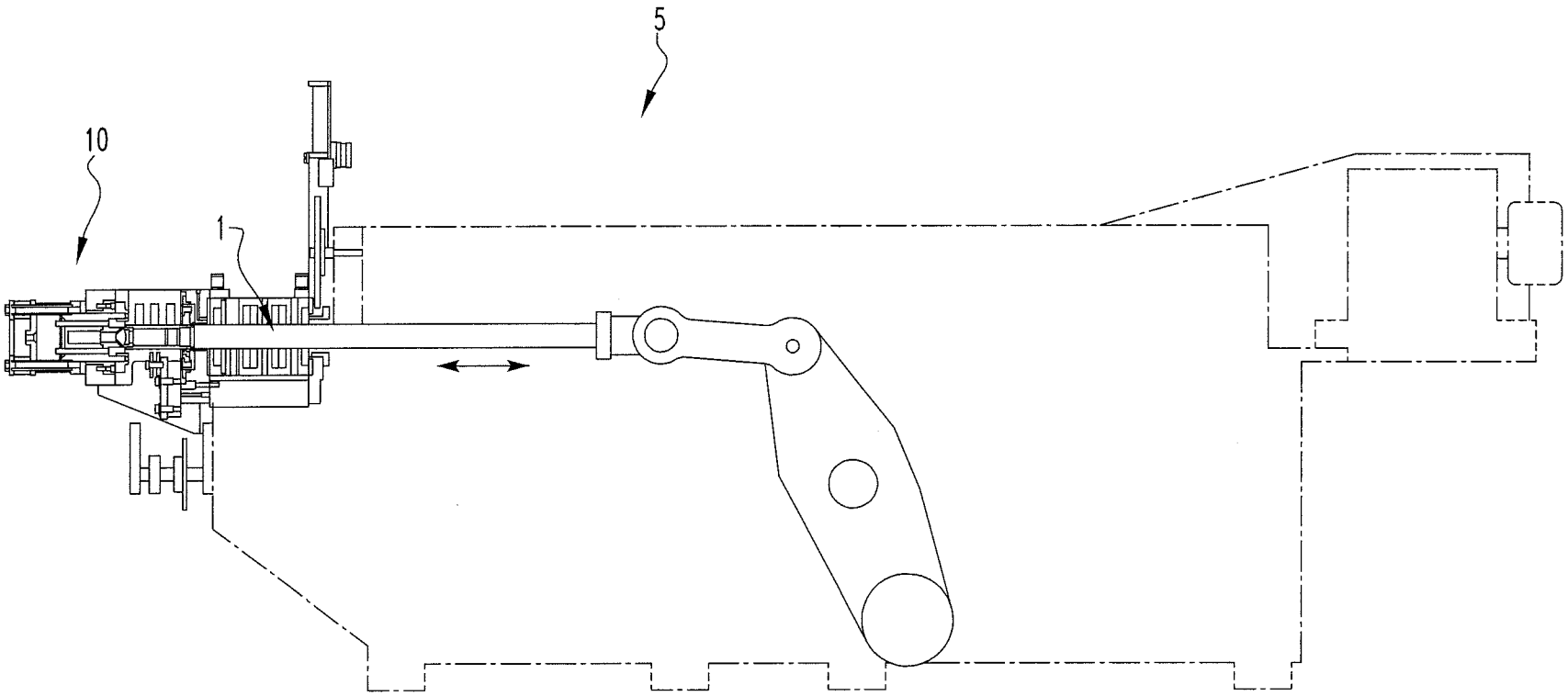
FIG. 1 is a side view of a body maker
Figure 2:
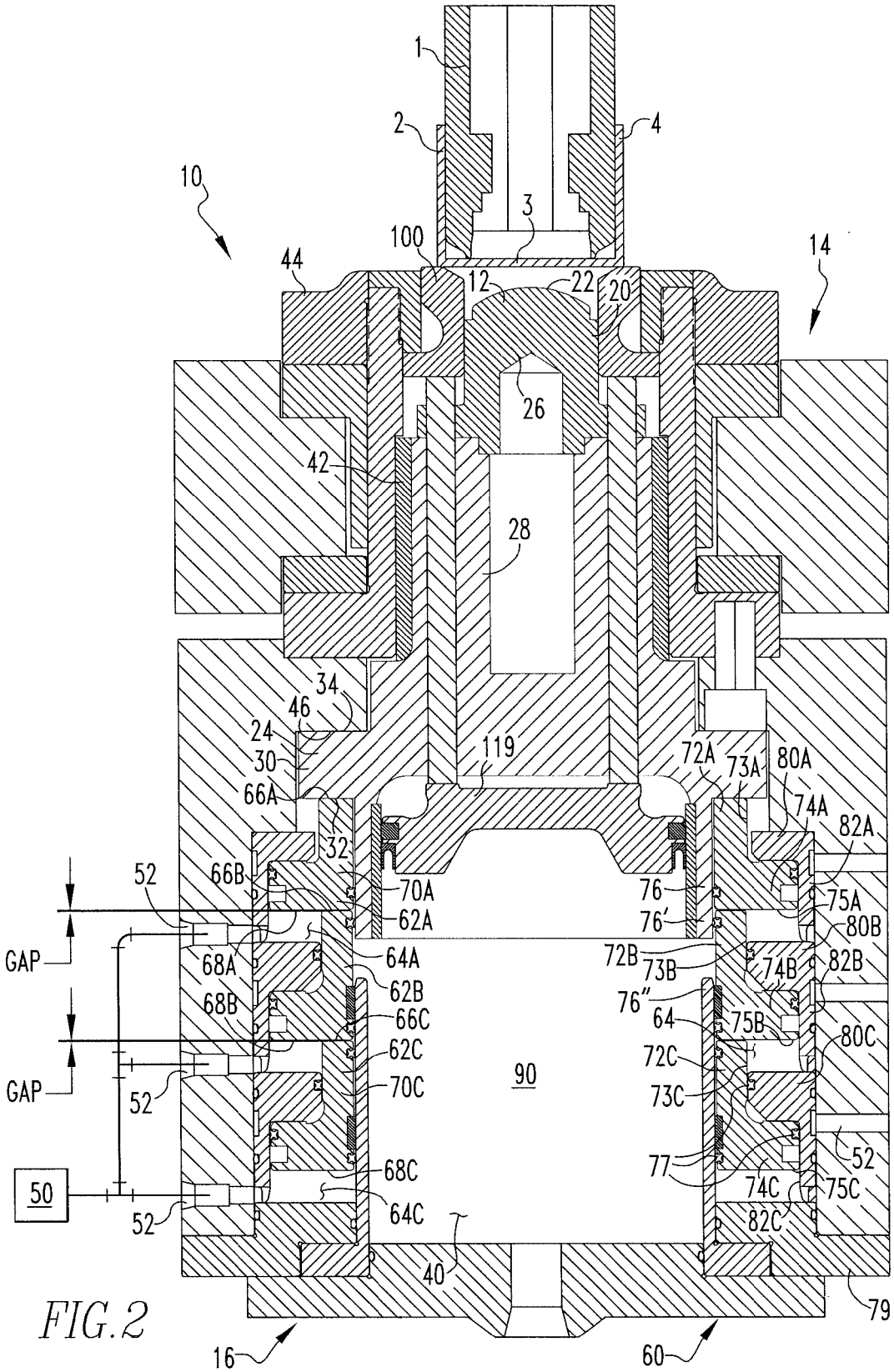
FIG. 2 is a cross-sectional view of a domer station in a first position.
Figure 3:
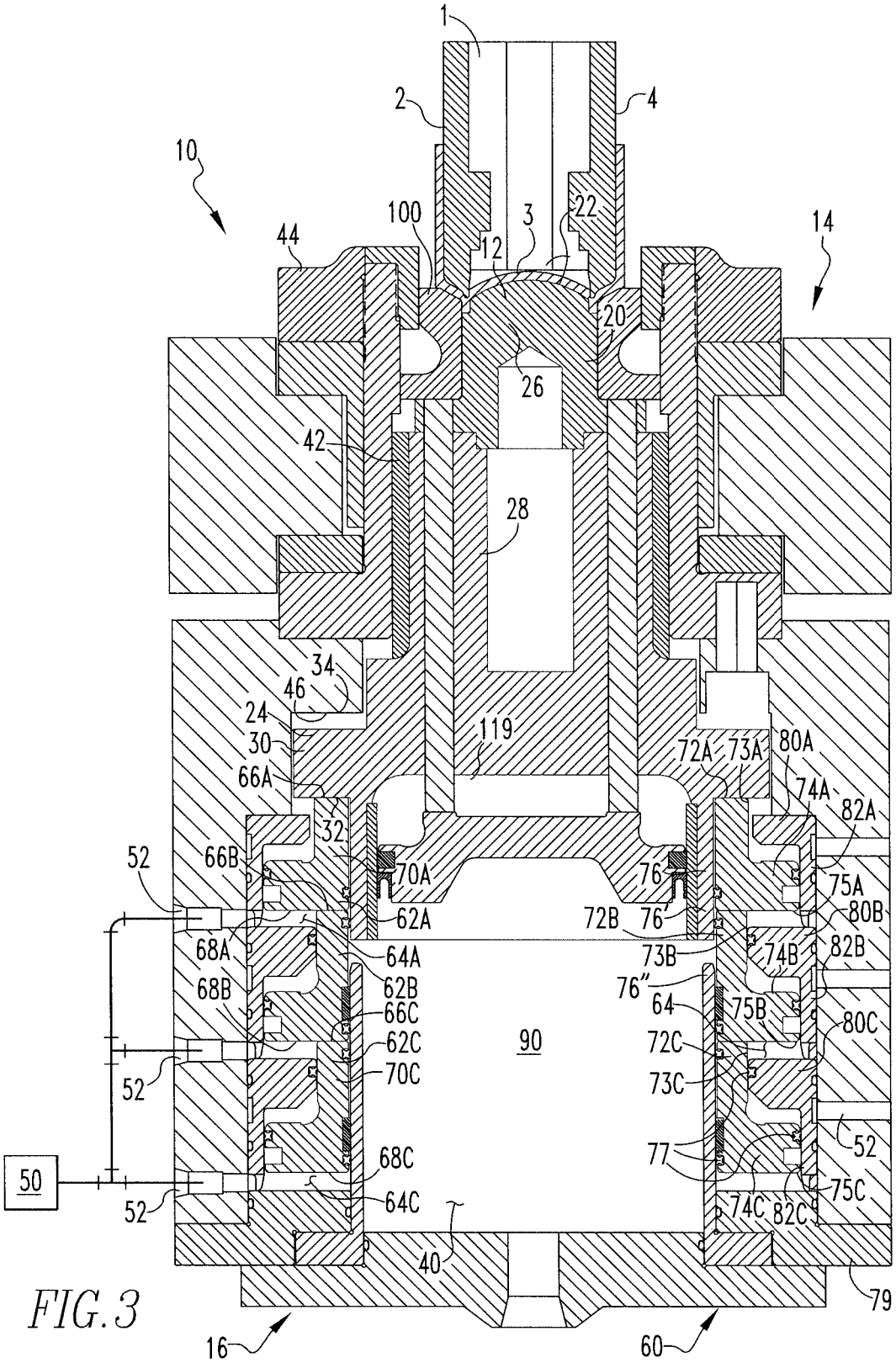
FIG. 3 is a cross-sectional view of a domer station in a second position.

As is known and is shown in FIG. 1, a body maker 5 for a metal container includes a ram or a punch 1 that supports, and may form, a cup-like member 2. As shown in FIGS. 2 and 3, the cup-like member 2 is temporarily disposed over the end of the elongated, reciprocating punch 1. That is, the punch 1 has a forward stroke and a return stroke. On each forward stroke of the punch 1, a new cup-like member 2 is picked up or formed. Near the end of the forward stroke, the cup-like member 2 engages a domer station 10 structured to form a dome in the bottom of the cup-like member 2. That is, the cup-like member 2 has a bottom member 3 and a depending sidewall 4. Prior to engaging the domer station 10, the bottom member 3 is generally planar. The domer station 10 creates a deformation in the bottom member 3 that is an inwardly extending dome. As is known, the dome may include peripheral structures, such as but not limited to, a peripheral, downwardly extending ridge. The specific shape of the dome is not relevant to this disclosure, but is noted as the clamping ring assembly 100, discussed below, is typically used to form such peripheral structures. It is further noted that the punch 1 and cup-like member 2 may have any cross-sectional shape, but circular is the most common. As such, the remaining portion of the detailed description shall refer to a cylindrical punch 1 and cup-like member 2, but it is understood that the invention is not limited to a single cross-sectional shape. Similarly, the elements of the domer station 10 may have any cross-sectional shape, but circular is most common. As such, the remaining portion of the detailed description shall refer to the elements of the domer station 10 as having a circular cross-section, but it is understood that the invention is not limited to a single cross-sectional shape.

The domer station 10 includes a domer assembly 12, a housing assembly 14, and a shock absorbing assembly 16. The domer assembly 12 includes a generally cylindrical body 20 with a domed axial first end 22 and an opposing second end 24. As shown, the domer assembly body 20, hereinafter, "the domer body 20," may be comprised of a dome member 26 and an elongated cylindrical member 28 that are coupled together. The domer body second end 24, i.e. the end of the cylindrical member 28 opposite the dome member 26, may include an outwardly extending flange 30 having a rearwardly facing axial engagement surface 32 and a forwardly facing stop surface 34. The domed axial first end 22 is shaped as needed to form a dome in the cup-like member 2 and may include a shaped periphery structured to form peripheral structures about the dome, as noted above. The domer body 20 is movably disposed within the housing assembly 14. More specifically, the domer body 20 has a longitudinal axis that is substantially aligned with the longitudinal axis of the punch 1. The domer body 20 is structured to move axially between a forward position and a retracted position, as described below.

The housing assembly 14 defines a domer body passage 40. The domer body passage 40 is shaped to accommodate the domer body 20 and, as is known, includes bearings 42 and retaining devices 44 structured to maintain the domer body 20 within the housing assembly 14. The bearings 42 and retaining devices 44 are well known and will not be discussed in detail except to note that the housing assembly 14 also defines a domer body stop ledge 46 within the domer body passage 40. The housing assembly 14 further defines fluid passages 52 that are part of the pressurized fluid supply 50, described below. The domer body 20 is movably disposed in the domer body passage 40 and structured to move between a forward position and a retracted position. In the forward position, the forward domer body flange stop surface 34 engages the housing assembly stop ledge 46. That is, when the domer body flange stop surface 34 engages the housing assembly stop ledge 46, the domer body 20 cannot travel any further toward the punch 1.

The domer assembly shock absorbing assembly 16 includes a pressurized fluid supply 50 and a stacked piston assembly 60. The domer assembly shock absorbing assembly pressurized fluid supply 50, shown schematically, is structured to supply pressurized fluid, preferably a gas, i.e. a pneumatic fluid. The pressurized fluid supply 50 further includes a plurality of fluid passages 52 extending through the housing assembly 14. The fluid passages 52 extend between the pressurized fluid supply 50, e.g. a compressor (not shown), and a plurality of pressure chambers 64, described below. The plurality of fluid passages 52 further includes exhaust passages 52 extending through the housing assembly 14.

The domer assembly shock absorbing assembly stacked piston assembly 60, hereinafter "the domer stacked piston assembly 60," includes a plurality of domer pistons 62. Herein a first, second, and third domer piston 62A, 62B, 62C are discussed, however it is understood that any number of domer pistons 62 (more than one) may be used. Each piston 62 is disposed in a pressure chamber 64. That is, each domer piston 62A, 62B, 62C has an associated pressure chamber 64A, 64B, 64C. Except as noted, each domer piston 62 and domer pressure chamber 64 are substantially similar. As such, only one domer piston 62A will be described, but it is understood that similar elements exist on each piston 62 and may be identified by the letter associated with each element. For example, the first domer piston 62A includes a forward side 66A and a rearward side 68A. Thus, it is understood that the second and third domer pistons 62B, 62C each have a forward side 66B, 66C and a rearward side 68B, 68C as well. Each domer piston 62A, 62B, 62C is structured to move, independently of each other, between a forward position and a retracted position. Each domer piston 62A, 62B, 62C moves over a line generally aligned with the longitudinal axis of the punch 1.

As noted above, the elements of the domer station 10, preferably, have a circular cross-sectional shape. The first domer piston 62A has a generally cylindrical body 70A. To accommodate the clamping assembly stacked piston assembly 140, discussed below, the first domer piston body 70A is preferably hollow and has an inner radius. The first piston body 70A further defines an axially extending portion 72A and a radially extending portion 74A. That is, the first domer piston body 70A has an L-shaped cross-section with a wide outer radius portion 75A, i.e. the radially extending portion 74A, and a narrow outer radius portion 73A, i.e. the axially extending portion 72A.

As discussed herein, only the forwardly facing surfaces of the axially extending portion 72A, i.e. the narrow outer radius portion 73A, is the forward side 66A of the first domer piston body 70A. This is because, due to the placement of seals 77 in the domer pressure chambers 64A, 64B, 64C, discussed below, only the forward facing axial surfaces of the second and third piston narrow outer radius portion 73B, 73C are exposed to pressurized fluid. That is, the forward facing axial surface of the wide outer radius portions 75B, 75C are not exposed to pressurized fluid. Further, the entire rearwardly facing axial surface of the wide outer radius portion 75A, 75B, 75C of each domer piston 62 is exposed to pressurized fluid.

The domer pressure chambers 64A, 64B, 64C, are defined by the housing assembly 14 as well as the domer pistons 62A, 62B, 62C themselves. That is, the inner radius of the domer body passage 40 defines the outer edge of each domer pressure chamber 64A, 64B, 64C. Further, an inner collar 76 that has a smaller radius than the domer pistons 62A, 62B, 62C, i.e. a collar 76 that is spaced inwardly from the inner radius of the domer body passage 40, defines the inner periphery of the domer pressure chambers 64A, 64B, 64C. The collar 76 may be coupled to the housing assembly 14 (collar 76') or may extend axially from the domer body second end 24 (collar 76") or may be bifurcated as shown. At the rearward end, furthest from the domer body 20, of the collar 76 is an end cap 79. The end cap 79 extends between the housing assembly 14 and the collar 76, and is sealed, thereby defining the back end of the third domer pressure chamber 64C. The gap between the collar 76 and the inner radius of the domer body passage 40 is sized to be substantially the same as the width of the wide outer radius portion 75A, 75B, 75C of each domer piston 62. Thus, when the domer pistons 62A, 62B, 62C are disposed between the collar 76 and the inner radius of the domer body passage 40, the domer pistons 62 separate the space into the separate domer pressure chambers 64A, 64B, 64C. Further, each domer piston 62A, 62B, 62C includes at least one seal 77 on both inner and outer radial surfaces of the wide outer radius portion 75A, 75B, 75C. The seal 77 on the inner radial surfaces of the wide outer radius portion 75A, 75B, 75C sealingly engages the collar 76 and the seal 77 in the outer radial surfaces of the wide outer radius portion 75A, 75B, 75C engage the inner radius of the domer body passage 40.

Each domer pressure chamber 64A, 64B, 64C is further defined by a radially extending stop 80A, 80B, 80C. Each domer stop is disposed forward, i.e. closer to the domer body 20, of the associated domer piston 62A, 62B, 62C. The radially extending domer stop 80A, 80B, 80C engages the associated piston wide outer radius portions 75A, 75B, 75C when the domer piston 62 is in the forward position. The domer stops 80A, 80B, 80C do not extend across the gap between the collar 76 and the inner radius of the domer body passage 40. Thus, the narrow outer radius portion 73A, i.e. the axially extending portion 72A, of each domer piston 62A, 62B, 62C may extend forwardly beyond the domer stop 80A, 80B, 80C. Thus, the forward side 66B, 66C and the narrow outer radius portion 73B, 73C of the second and third domer piston 62B, 62C extend into the next forward domer pressure chamber 64A, 64B, respectively. It is noted that a seal 77 is disposed between the domer stop 80A, 80B, 80C and the associated piston axially extending portion 72A.

Further, each domer stop 80A, 80B, 80C may include a rearwardly extending leg 82A, 82B, 82C disposed against the inner radius of the domer body passage 40. The rearwardly extending legs 82A, 82B, 82C may be structured, e.g. polished, made from selected materials, etc., to provide a better sealing surface for the seal 77 disposed on the outer radial surfaces of each piston wide outer radius portion 75A, 75B, 75C. In this configuration, the width of the wide outer radius portion 75A, 75B, 75C of each domer piston 62 is sized so as to fit between the collar 76 and the rearwardly extending legs 82A, 82B, 82C, rather than between the collar 76 and the inner radius of the domer body passage 40.

The pressurized fluid supply fluid passages 52 are structured to communicate a pressurized fluid into each domer pressure chamber 64A, 64B, 64C at a location rearwardly of the domer piston 62A, 62B, 62C in each domer pressure chamber 64A, 64B, 64C. That is, the pressurized fluid biases each domer piston 62A, 62B, 62C forwardly, i.e. toward the domer body 20. Further, the radially extending domer stops 80A, 80B, 80C, along with the seals 77, ensures that the pressurized fluid does not act upon the forward face of the of the wide outer radius portions 75A, 75B, 75C. Thus, when a substantially constant and uniform pressure is applied to the domer pressure chambers 64A, 64B, 64C, there is a greater surface area on each domer piston rearward side 68A, 68B, 68C that is exposed to the pressurized fluid. That is, even though the narrow outer radius portion 73B, 73C of the second and third domer piston 62B, 62C extend into the next forward domer pressure chamber 64A, 64B, respectively, the surface area of the second and third domer piston 62B, 62C that is being exposed to pressurized fluid in the next forward pressure chamber 64A, 64B is much smaller than the surface area of each piston rearward side 68A, 68B, 68C. Thus, the pistons 62A, 62B, 62C are biased forwardly.

Further, the domer stops 80A, 80B, 80C are positioned so that when each domer piston 62A, 62B, 62C is in the forward position, i.e. each with the wide outer radius portion 75A, 75B, 75C engaging the associated domer stop 80A, 80B, 80C, each domer piston forward side 66A, 66B, 66C is spaced from the next adjacent surface by a predetermined spacing. That is, the first domer piston forward side 66A is spaced from the rearwardly facing axial engagement surface 32, the second domer piston forward side 66B is spaced from the first domer piston rearward side 68A, and the third domer piston forward side 66C is spaced from the second domer piston rearward side 68B. Preferably, the first domer piston forward side 66A is spaced from the rearwardly facing axial engagement surface 32 by a gap of between about 0.002 and 0.005 inch, and more preferably by about 0.005 inch. Preferably, the second domer piston forward side 66B is spaced from the first domer piston rearward side 68A by a gap of between about 0.010 and 0.015 inch, and more preferably by about 0.015 inch. Preferably, the third domer piston forward side 66C is spaced from the second piston rearward side 68B by a gap of between about 0.010 and 0.015 inch, and more preferably by about 0.015 inch.

In this configuration, the domer pistons 62A, 62B, 62C are stacked in series and structured to move between a first position, wherein each domer piston 62A, 62B, 62C does not operatively engage the domer body 20, and a second, operatively engaged position, wherein each domer piston 62A, 62B, 62C operatively engages the domer body 20. Further, because the domer pistons 62A, 62B, 62C move independently, the domer pistons 62A, 62B, 62C are structured to incrementally operatively engage the domer body 20. That is, each domer piston 62A, 62B, 62C is structured to incrementally apply bias to the domer body 20. This is accomplished by having the domer body 20 move axially toward, and then engage, the domer stacked pistons 62A, 62B, 62C. That is, when the punch 1 engages the domer body 20, the domer body 20 moves in a direction substantially aligned with the longitudinal axis of the punch 1. Movement in this direction moves the domer body 20 into engagement with the domer stacked piston assembly 60. As noted above, the pressurized fluid supply 50 is supplying a constant pressurized fluid to the domer stacked piston pressure chambers 64A, 64B, 64C thereby biasing the domer stacked pistons 62A, 62B, 62C toward the domer body 20. Further, because the domer stacked pistons 62A, 62B, 62C are spaced from each other, the domer body 20 incrementally engages the domer stacked pistons 62A, 62B, 62C. That is, the domer body 20 first contacts, and directly engages and operatively engages, the domer stacked piston assembly first piston 62A. At this point, only the domer stacked piston assembly first piston 62A is engaging the domer body 20. The bias created by the domer stacked piston assembly first piston 62A, however, is not sufficient to overcome the bias of the punch 1. Thus, while the domer stacked piston assembly first piston 62A does apply bias to the domer body 20, the domer body 20 continues moving rearwardly. This causes the domer stacked piston assembly first domer piston 62A to be moved into operative engagement with the second piston 62B. That is, the domer stacked piston assembly second piston forward side 66B directly engages the domer stacked piston assembly first piston second rearward side 68A. At this point, the first and second domer pistons 62A, 62B are operatively engaging the domer body 20. Again, however, the bias created by the first and second domer pistons 62A, 62B is not sufficient to overcome the bias of the punch 1 and the domer body 20 continues to move rearwardly. This causes the second domer piston 62B to be moved into operative engagement with the third domer piston 62C. That is, the domer stacked piston assembly third piston forward side 66C directly engages the domer stacked piston assembly second piston second side 68B. The third piston 62C may briefly move rearwardly as well, but the combined bias of the domer stacked pistons 62A, 62B, 62C is sufficient to overcome the bias of the punch 1 and the movement of the domer body 20 is arrested. When the domer body 20 is at its most rearward location, it is in the second, retracted position and each domer piston 62A, 62B, 62C, is in its second position. Further, the punch 1 is at its most extended position when the domer body 20 is at its most rearward location. That is, the punch 1 begins its return stroke away from the domer body 20 at this point in the cycle.

As noted above, a cup-like member 2 is disposed over the end of the punch 1. It is the cup-like member 3 that contacts the domer body 20 and, more specifically, the domer body domed axial first end 22. The cup-like member 3 begins to deform, that is, begins to be formed into a dome, when the first piston 62A operatively engages the domer body 20. As the second and third domer pistons 62B, 62C also operatively engage the domer body 20, the can-like body bottom member 3 completes the forming operation thereby forming an inwardly domed bottom member 3. It is noted that, because of the predetermined spacing between the domer stacked pistons 62A, 62B, 62C, the bias of the domer stacked pistons 62A, 62B, 62C is applied incrementally. Moreover, the timing of how rapidly or slowly the bias is applied may be controlled by decreasing or increasing the predetermined spacing between the domer stacked pistons 62A, 62B, 62C.

After the domer body 20 is at its retracted position and the punch 1 begins to retract, the bias from the domer stacked pistons 62A, 62B, 62C cause the domer body 20 to move back toward the domer body 20 first position. Each domer stacked piston 62A, 62B, 62C moves forwardly until coming into contact with an associated domer stop 80A, 80B, 80C. When each domer stacked piston 62A, 62B, 62C comes into contact with an associated domer stop 80A, 80B, 80C, the forward motion of the domer piston 62A, 62B, 62C is arrested; this is the first position for each domer piston 62A, 62B, 62C. The bias created by the pressurized fluid supply 50 maintains the domer stacked pistons 62A, 62B, 62C in their first position until the domer body 20 again engages the domer stacked piston assembly 60. It is noted that the gap between the first domer piston forward side 66A and the housing assembly stop ledge 46 is slightly greater than the thickness of the domer body flange 30. Thus, the domer body 20 moved forwardly until the domer body flange 30 contacts the housing assembly stop ledge 46 and/or the first domer piston 62A engages the first domer piston stop 80A. This is the domer body 20 first position and the domer body 20 is not operatively engaged by the domer stacked piston assembly 60 even if the first domer piston 62A is contacting the domer body flange 30.

Figure 4:
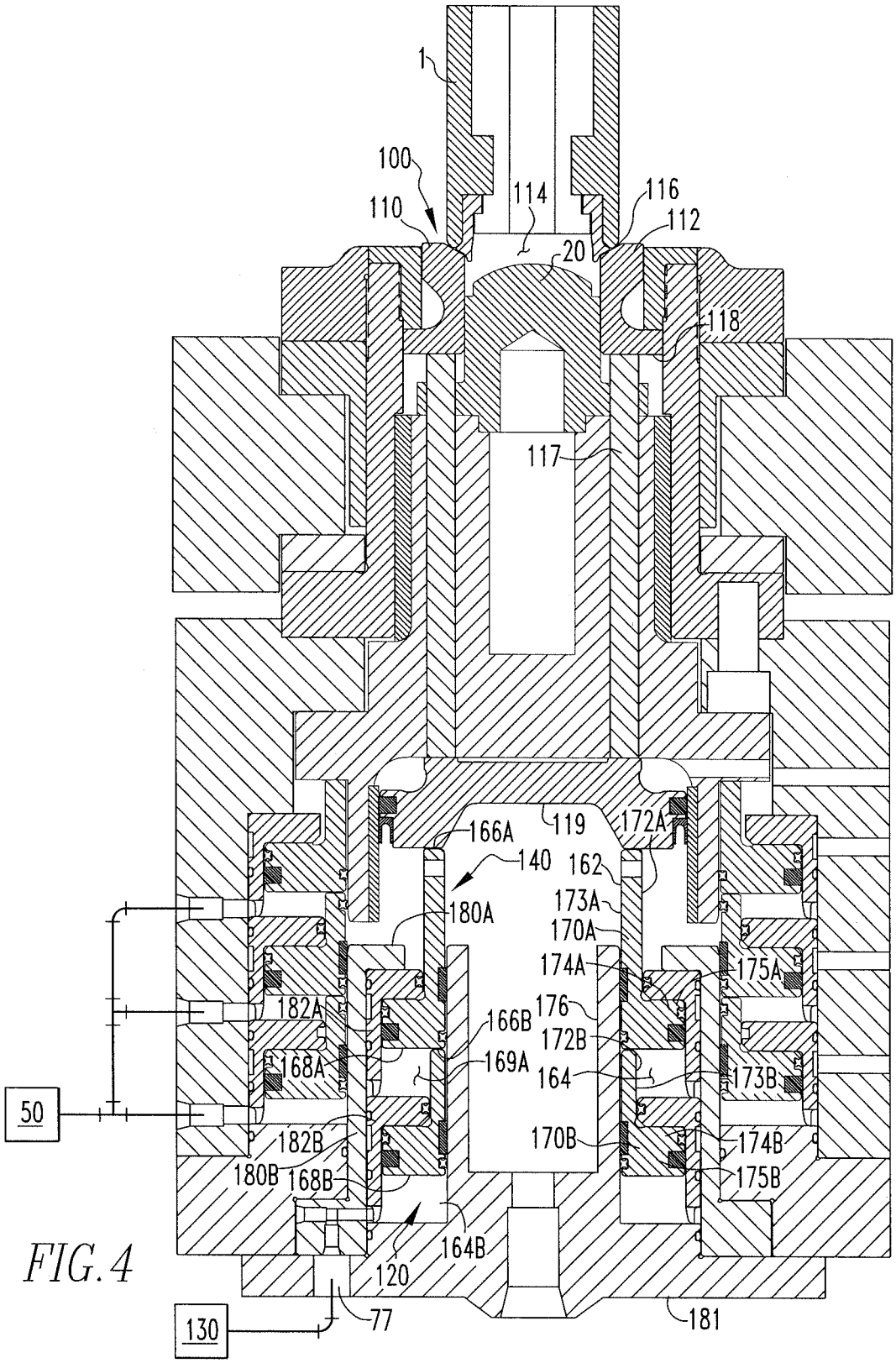
FIG. 4 is a cross-sectional view of a domer station having a clamping assembly shock absorbing piston assembly in a first position.
Figure 5:
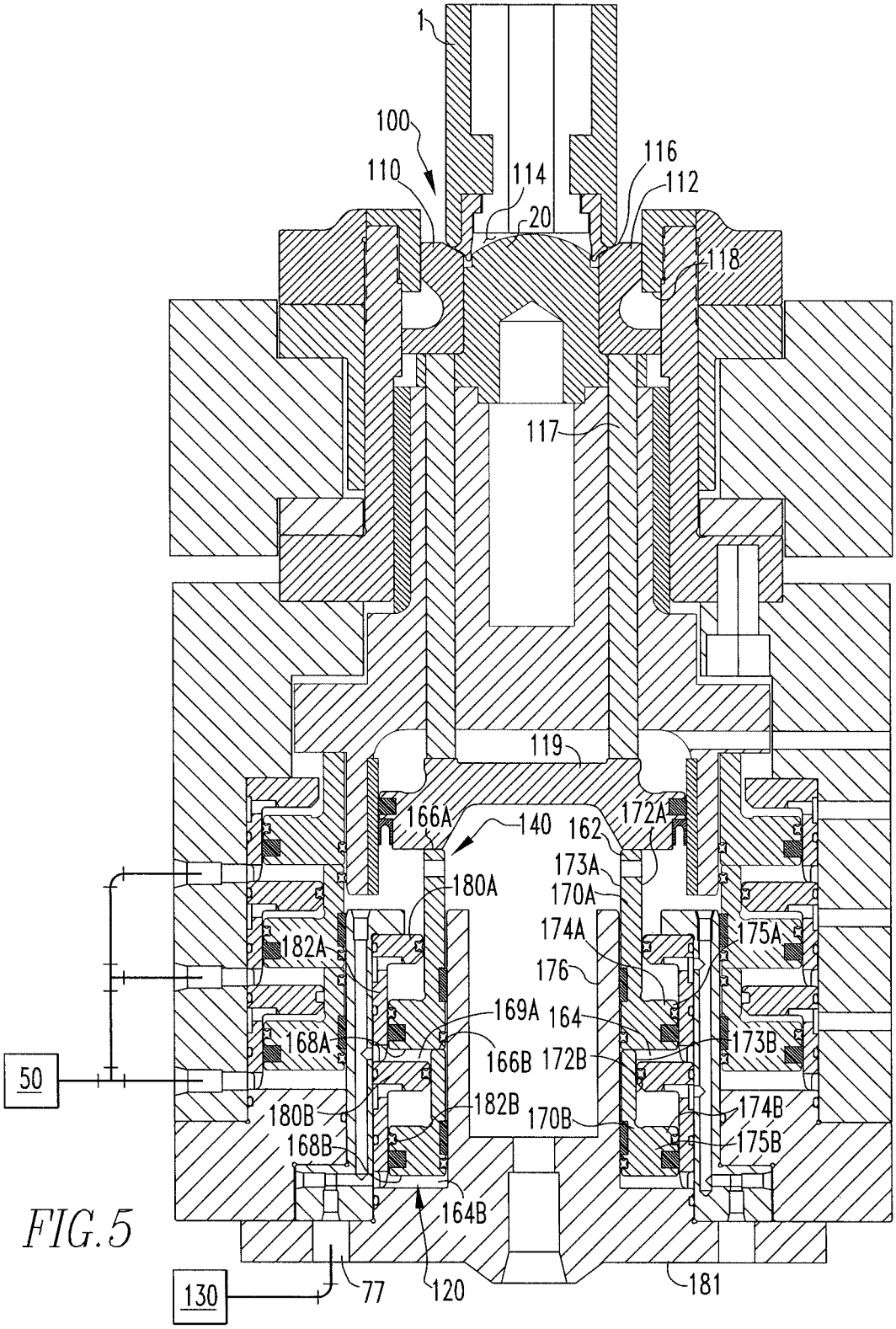
FIG. 5 is a cross-sectional view of a domer station having a clamping assembly shock absorbing piston assembly is a second position.

The domer assembly 12 may include a clamping ring assembly 100. The clamping ring assembly 100 preferably includes a clamping ring 110 that is disposed about the dome member 26. The clamping ring 110 is movably coupled to the domer body 20 as described below. In a simplified embodiment, the clamping assembly mounting plate 119, described below, is disposed in the domer body passage 40 which may be pressurized. That is, the domer body passage 40 may be a pressure chamber 90 for the clamping assembly 100 and is structured to bias the clamping assembly mounting plate 119, and therefore the clamping ring 110, forwardly. As shown in FIGS. 4 and 5, however, the clamping assembly 100 preferably includes a shock absorbing assembly 120 as well.

The clamping ring 110 has a body 112 with a central opening 114, a first side 116 and a second side 118. When the domer body 20 has a circular cross-section, the clamping ring body 112 is, preferably, a torus. The clamping ring body 112 is disposed about the domer body first end 22. The clamping ring body 112 is structured to move axially relative to the domer body 20. That is, the clamping ring body 112 moves between a forward first position and a retracted second position. As noted above, the domer stacked piston assembly 60 is, preferably, hollow thereby allowing the clamping ring assembly shock absorbing assembly 120 to be disposed within the domer stacked piston assembly 60. As such, the clamping ring body 112 must include extensions 117 structured to couple the clamping ring body 112 to the clamping ring assembly shock absorbing assembly 120. These extensions 117 are, preferably a plurality of rods extending through the domer body 20. The extensions 117 are further coupled to a mounting plate 119 disposed in the domer stacked piston assembly 60 hollow space. The clamping ring body 112, the extensions 117 and the mounting plate 119 are coupled in a fixed relation. Therefore, movement of one element results in a corresponding movement in the other elements.

The clamping ring assembly shock absorbing assembly 120 is structured to bias the clamping ring body 112 toward the clamping ring body 112 first position. The clamping ring assembly shock absorbing assembly 120 has a pressurized fluid supply 130 and a stacked piston assembly 140. The clamping ring assembly shock absorbing assembly pressurized fluid supply 130 may be the domer assembly shock absorbing assembly pressurized fluid supply 50 and utilizes the housing assembly fluid passages 52.

The domer assembly clamping ring assembly shock absorbing assembly stacked piston assembly 140, hereinafter the "clamping assembly stacked piston assembly 140" is structured and operates in a manner substantially similar to the domer stacked piston assembly 60. The clamping assembly stacked piston assembly 140 includes a plurality of pistons 162. Herein a first and second clamping assembly piston 162A, 162B, are discussed, however it is understood that any number of pistons 162 (more than one) may be used. Each clamping assembly piston 162 is disposed in a pressure chamber 164. That is, each clamping assembly piston 162A, 162B has an associated pressure chamber 164A, 164B. Except as noted, each clamping assembly piston 162 and clamping assembly pressure chamber 164 are substantially similar. As such, only one clamping assembly piston 162A will be described, but it is understood that similar elements exist on each clamping assembly piston 162 and may be identified by the letter associated with each element. For example, the first clamping assembly piston 162A includes a forward side 166A and a rearward side 168A. Thus, it is understood that the second clamping assembly piston 162B also has a forward side 166B and a rearward side 168B. Each clamping assembly piston 162A, 162B is structured to move, independently of each other, between a forward position and a retracted position. Each piston 162A, 162B moves over a line generally aligned with the longitudinal axis of the punch 1.

The first clamping assembly piston 162A has a generally cylindrical body 170A which is preferably hollow and has an inner radius. The first clamping assembly piston body 170A further defines an axially extending portion 172A and a radially extending portion 174A. That is, the first clamping assembly piston body 170A has an L-shaped cross-section with a wide outer radius portion 175A, i.e. the radially extending portion 174A, and a narrow outer radius portion 173A, i.e. the axially extending portion 172A. As before, only the forwardly facing surface of the clamping assembly piston axially extending portion 172A, i.e. the clamping assembly narrow outer radius portion 173A, is the forward side 166A of the clamping assembly first piston body 170A.

The clamping assembly pressure chambers 164A, 164B are defined by the housing assembly 14 as well as the clamping assembly pistons 162A, 162B themselves. That is, the inner radius of the inner collar 76 defines the outer edge of each pressure chamber 164A, 164B, 164C. Further, another clamping assembly inner collar 176 that has a smaller radius than the pistons 162A, 162B, i.e. a collar 176 that is spaced inwardly from the inner radius of the inner collar 76 defines the inner periphery of the pressure chambers 164A, 164B. The clamping assembly collar 176 may extend from an end plate 181 that is coupled to the housing assembly 14. The clamping assembly collar end plate 181 is disposed at the rearward end of the housing assembly 14. The clamping assembly collar end plate 175 defines the back end of the second clamping assembly pressure chamber 164B. The gap between the clamping assembly collar 176 and the inner radius of the inner collar 76 is sized to be substantially the same as the width of the clamping assembly wide otiter radius portion 175A, 175B of each piston 162A, 162B. Thus, when the clamping assembly pistons 162A, 162B, are disposed between the clamping assembly collar 176 and the inner radius of the inner collar 76, the clamping assembly pistons 162A, 162B separate the space into the separate clamping assembly pressure chambers 164A, 164B. Further, each clamping assembly piston 162A, 162B, 62C includes at least one seal 77 on both inner and outer radial surfaces of the wide outer radius portion 175A, 175B. The seal 77 on the inner radial surfaces of the clamping assembly wide outer radius portion 175A, 175B sealingly engages the clamping assembly collar 176 and the seal 77 in the outer radial surfaces of the clamping assembly wide outer radius portion 175A, 175B sealingly engage the inner radius of the inner collar 76.

Each clamping assembly pressure chamber 164A, 164B is further defined by a radially extending clamping assembly stop 180A, 180B. Each clamping assembly stop 180A, 180B is disposed forward, i.e. closer to the domer body 20, of the associated clamping assembly piston 162A, 162B. The radially extending clamping assembly stop 180A, 180B engages the associated clamping assembly piston wide outer radius portions 175A, 175B when the clamping assembly piston 162A, 162B is in the forward position. The clamping assembly stops 180A, 180B do not extend across the gap between the clamping assembly collar 176 and the inner radius of the inner collar 76. Thus, the clamping assembly piston narrow outer radius portion 173A, i.e. the clamping assembly piston axially extending portion 172A, of each clamping assembly piston 162A, 162B may extend forwardly beyond the clamping assembly stop 180A, 180B. Thus, the clamping assembly piston forward side 166B and the clamping assembly piston narrow outer radius portion 173B of the clamping assembly second piston 162B extends into the clamping assembly first piston pressure chamber 164A. It is noted that a seal 77 is disposed between the clamping assembly stop 180A, 180B and the associated piston axially extending portion 172A.

Further, each clamping assembly stop 180A, 180B may include a rearwardly extending leg 182A, 182B disposed against the inner radius of the inner collar 76. The clamping assembly rearwardly extending legs 182A, 182B may be structured, e.g. polished, made from selected materials, etc., to provide a better sealing surface for the seal 77 disposed on the outer radial surfaces of each clamping assembly piston wide outer radius portion 175A, 175B. In this configuration, the width of the clamping assembly piston wide outer radius portion 175A, 75B of each piston 162A, 162B is sized so as to fit between the clamping assembly collar 176 and the rearwardly extending legs 182A, 182B rather than between the clamping assembly collar 176 and the inner radius of the inner collar 76.

The pressurized fluid supply fluid passages 52 are structured to communicate a pressurized fluid into each clamping assembly pressure chamber 164A, 164B at a location rearwardly of the clamping assembly piston 162A, 162B in each pressure chamber 164A, 164B. That is, the pressurized fluid biases each clamping assembly piston 162A, 162B forwardly, i.e. toward the clamping assembly mounting plate 119. Further, the radially extending clamping assembly stop 180A, 180B along with the seals 77, ensures that the pressurized fluid does not act upon the forward face of each clamping assembly piston wide outer radius portions 175A, 175B. As described above, the difference in the piston surface areas results in the clamping assembly pistons 162A, 162B being biased forwardly.

Further, the clamping assembly stops 180A, 180B are positioned so that when each clamping assembly piston 162A, 162B is in the forward position, i.e. each with the clamping assembly piston wide outer radius portion 175A, 175B engaging the associated clamping assembly stop 180A, 180B, each clamping assembly piston forward side 166A, 166B is spaced from the next adjacent surface by a predetermined spacing. That is, the first clamping assembly piston forward side 166A is spaced from the clamping assembly mounting plate 119, and, the second piston forward side 166B is spaced from the first piston rearward side 168A. Preferably, the first clamping assembly piston forward side 166A is spaced from the clamping assembly mounting plate 119 by a gap of between about 0.002 and 0.005 inch, and more preferably by about 0.002 inch. Preferably, the second piston forward side 166B is spaced from the first piston rearward side 168A by a gap of between about 0.010 and 0.015 inch, and more preferably by about 0.015 inch.

The operation of the clamping assembly stacked piston assembly 140 is substantially similar to the operation of the domer stacked piston assembly 60 and will not be described in detail. It is noted that the forward side of the clamping ring body 112 is disposed closer to the punch 1 than the domer body 20. As such, the clamping ring body 112 is contacted by the punch 1 before the domer body 20 and the clamping assembly stacked piston assembly 140 is actuated before the domer stacked piston assembly 60.

Figure 6:
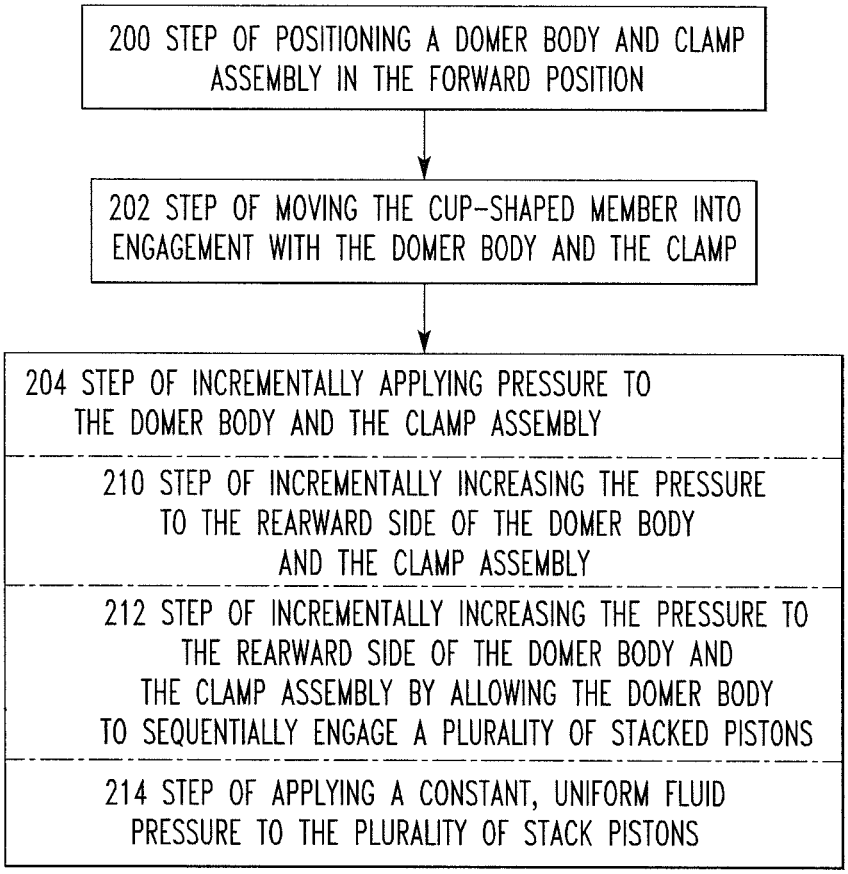
FIG. 6 is a flow chart of the steps for a method of forming a dome in the bottom of a cup-shaped member.

Utilizing the domer station 10 described above, a dome may be formed in the bottom of a cup-shaped member 2 by performing the steps, as shown in FIG. 6, of positioning 200 a domer body and clamp assembly in the forward position, moving 202 the cup-shaped member 2 into engagement with the domer body 20 and the clamp assembly 100 while allowing the domer body 20 and the clamp assembly 100 to move toward a rearward position, and, incrementally applying 204 pressure to the domer body 20 and the clamp assembly 100 thereby biasing the domer body 20 and the clamp assembly 100 toward the forward position, whereby the bottom of the cup-shaped member 2 is deformed. That is, the step of incrementally applying 204 pressure to the rearward side of the domer body 20 and the clamp assembly 100 includes the step of incrementally increasing 210 the pressure to the rearward side of the domer body 20 and the clamp assembly 100. More specifically, the step of applying 204 pressure to the rearward side of the domer body 20 and the clamp assembly 100 includes the step of incrementally increasing 212 the pressure to the rearward side of the domer body 20 and the clamp assembly 100 by allowing the domer body 20 to sequentially engage a plurality of stacked pistons. As noted above, the sequential engagement of the plurality of stacked pistons 60 is accomplished by providing a predetermined spacing between the stacked pistons 60. Further the step of applying 204 pressure to the rearward side of the domer body 20 and the clamp assembly 100 includes the step of applying 214 a constant, uniform fluid pressure to the plurality of stacked pistons 60.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A doming station comprising:

a domer assembly having a domer body with a domed axial first end and an opposing second end;

a housing assembly defining a domer body passage, said domer body passage having a longitudinal axis and being sized to accommodate said domer body whereby said domer body is movably disposed in said domer body passage and structured to move between a forward position and a rearward position;

said domer body movably disposed in said domer body passage and structured to move substantially along said domer body passage longitudinal axis between a forward, first position and a retracted, second position;

a domer assembly shock absorbing assembly having a pressurized fluid supply and a stacked piston assembly;

said domer stacked piston assembly having a plurality of pistons, each said piston having an associated pressure chamber, said pistons disposed in series and located in said domer body passage, each said piston having a forward side and a rearward side, each said piston structured to move between a first position, wherein each said piston does not operatively engage said domer body, and a second, operatively engaged position, wherein each said piston operatively engages said domer body;

said domer stacked piston assembly pistons disposed in series structured to operatively engage said domer body second end;

said domer stacked piston assembly pressurized fluid supply structured to provide pressurized fluid to each said domer stacked piston assembly piston pressure chamber, whereby said each domer stacked piston assembly piston is structured to be biased toward said forward side and each domer stacked piston assembly piston is structured be moved independently between said first and second positions;

wherein, upon motion of said domer body toward said second position, each said domer stacked piston assembly piston is structured to operatively engage said domer body and bias said domer body toward said domer body forward position;

when said domer stacked piston assembly pistons are in said first position, each said domer stacked piston assembly piston is separated by a predetermined spacing; and whereby, when said domer body moves toward said second position, each said domer stacked piston assembly piston incrementally operatively engages said domer body second end, thereby incrementally increasing the pressure on said domer body second end.

2. The doming station of claim 1 wherein each said domer stacked piston assembly piston forward side has an area that is smaller than the piston second side area.

3. The doming station of claim 1 wherein:

said plurality of domer stacked piston assembly stacked pistons includes a first piston, a second piston, and a third piston;

said domer stacked piston assembly first piston forward side directly engaging said domer body;

said domer stacked piston assembly second piston forward side directly engaging said domer stacked piston assembly first piston second side; and said domer stacked piston assembly third piston forward side directly engaging said domer stacked piston assembly second piston second side.

4. The doming station of claim 1 wherein said domer assembly shock absorbing assembly pressurized fluid supply is a pneumatic fluid supply.

5. The doming station of claim 1 wherein each said domer assembly stacked piston assembly piston is structured to move independently.

6. A doming station comprising:

a domer assembly having a domer body with a domed axial end and an opposing second end;

a housing assembly defining a domer body passage, said domer body passage having a longitudinal axis and being sized to accommodate said domer body, whereby said domer body is movably disposed in said domer body passage and structured to move between a forward position and a rearward position;

said domer body movably disposed in said domer body passage and structured to move substantially along said domer body passage longitudinal axis between a forward, first position and a retracted, second position;

a domer assembly shock absorbing assembly having a pressurized fluid supply and a stacked piston assembly;

said domer stacked piston assembly having a plurality of pistons, each said piston having an associated pressure chamber, said pistons disposed in series and located in said domer body passage, each said piston having a forward side and a rearward side, each said piston structured to move between a first position, wherein each said piston does not operatively engage said domer body, and a second, operatively engaged position, wherein each said piston operatively engages said domer body;

said domer stacked piston assembly pistons disposed in series structured to operatively engage said domer body second end;

said domer stacked piston assembly pressurized fluid supply structured to provide pressurized fluid to each said domer stacked piston assembly piston pressure chamber, whereby said each domer stacked piston assembly piston is structured to be biased toward said forward side and each domer stacked piston assembly piston is structured be moved independently between said first and second positions;

wherein, upon motion of said domer body toward said second position, each said domer stacked piston assembly piston is structured to operatively engage said domer body and bias said domer body toward said domer body forward position;

each said domer stacked piston assembly piston has a generally cylindrical body with an L-shaped cross-section defining a wide outer radius portion of each said piston body and a narrow outer radius portion of each said piston body;

each said domer stacked piston assembly piston forward side being the axial face of each said domer stacked piston assembly piston body narrow outer radius portion; and each said domer stacked piston assembly piston rearward side being the axial face of each said domer stacked piston assembly piston body wide outer radius portion.

7. A doming station comprising:

a domer assembly having a domer body with a domed axial first end and an opposing second end;

a housing assembly defining a domer body passage, said domer body passage having a longitudinal axis and being sized to accommodate said domer body, whereby said domer body is movably disposed in said domer body passage and structured to move between a forward position and a rearward position;

said domer body movably disposed in said domer body passage and structured to move substantially along said domer body passage longitudinal axis between a forward, first position and a retracted, second position;

a domer assembly shock absorbing assembly having a pressurized fluid supply and a stacked piston assembly;

said domer stacked piston assembly having a plurality of pistons, each said piston having an associated pressure chamber, said pistons disposed in series and located in said domer body passage, each said piston having a forward side and a rearward side, each said piston structured to move between a first position, wherein each said piston does not operatively engage said domer body, and a second, operatively engaged position, wherein each said piston operatively engages said domer body;

said domer stacked piston assembly pistons disposed in series structured to operatively engage said domer body second end;

said domer stacked piston assembly pressurized fluid supply structured to provide pressurized fluid to each said domer stacked piston assembly piston pressure chamber, whereby said each domer stacked piston assembly piston is structured to be biased toward said forward side and each domer stacked piston assembly piston is structured be moved independently between said first and second positions;

wherein, upon motion of said domer body toward said second position, each said domer stacked piston assembly piston is structured to operatively engage said domer body and bias said domer body toward said domer body forward position;

said domer assembly further includes a clamping assembly, said clamping assembly having a clamping ring and a clamping assembly shock absorbing assembly;

said clamping ring having a body with a central opening, a first side and a second side, said clamping ring body disposed about said domer body first end, said clamping ring body structured to move relative to said domer body;

said clamping assembly shock absorbing assembly having a pressurized fluid supply and a stacked piston assembly;

said clamping stacked piston assembly having a plurality of pistons, each said piston having an associated pressure chamber, said pistons disposed in series and located in said domer body passage, each said piston having a forward side and a rearward side, each said piston structured to move between a first, retracted position, wherein each said piston does not operatively engage said clamping ring body, and a second, operatively engaged position, wherein each said piston operatively engages said clamping ring body;

said clamping pistons disposed in series structured to operatively engage said clamping ring body second side;

said pressurized fluid supply structured to provide a pressurized fluid to each said clamping stacked piston assembly piston pressure chamber, whereby said each clamping stacked piston assembly piston may be biased toward said forward side and each clamping stacked piston assembly piston may be moved independently between said first and second positions; and wherein, upon introduction of pressurized fluid independently to each said clamping stacked piston assembly piston chamber, each said clamping stacked piston assembly piston is structured to operatively engage said clamping ring body and bias said clamping ring body toward said clamping ring body forward position.

8. The doming station of claim 7 wherein:

when said clamping assembly stacked piston assembly pistons are in said first, retracted position, each said clamping assembly stacked piston assembly piston is separated by a predetermined spacing; and whereby, when a fluid is introduced into each clamping assembly stacked piston assembly pressure chamber, each said clamping assembly stacked piston assembly piston incrementally increases the pressure on said clamping ring body second side.

9. The doming station of claim 7 wherein each said clamping assembly stacked piston assembly piston forward side has an area that is smaller than the clamping assembly stacked piston assembly piston second side area.

10. The doming station of claim 7 wherein:

said plurality of clamping assembly stacked piston assembly stacked pistons includes a first piston, a second piston, and a third piston;

said clamping assembly stacked piston assembly first piston forward side directly engaging said domer body;

said clamping assembly stacked piston assembly second piston forward side directly engaging said clamping assembly stacked piston assembly first piston second side; and said clamping assembly stacked piston assembly third piston forward side directly engaging said clamping assembly stacked piston assembly second piston second side.

11. The doming station of claim 7 wherein:

each said clamping assembly stacked piston assembly piston has a generally cylindrical body with an L-shaped cross-section defining a wide outer radius portion of each said piston body and a narrow outer radius portion of each said piston body;

each said clamping assembly stacked piston assembly piston forward side being the axial face of each said piston body narrow outer radius portion;

each said clamping assembly stacked piston assembly piston rearward side being the axial face of each said piston body wide outer radius portion;

each said clamping assembly stacked piston assembly piston wide outer radius portion being smaller than said clamping assembly stacked piston assembly piston body narrow outer radius portion;

each domer stacked piston assembly piston having an inner radius;

each said clamping assembly stacked piston assembly piston body wide outer radius portion being smaller than said domer stacked piston assembly piston inner radius; and said clamping assembly stacked piston assembly disposed inside said domer stacked piston assembly.

12. The doming station of claim 7 wherein said clamping assembly shock absorbing assembly pressurized fluid supply is a pneumatic fluid supply.

13. The doming station of claim 7 wherein each said clamping assembly stacked piston assembly piston is structured to more independently.

* * * * *